United States Patent [19]

Traegaardh

[11] Patent Number: 5,011,467

[45] Date of Patent: Apr. 30, 1991

[54] TRANSPORT DEVICE FOR PACKING CONTAINER BLANKS

[75] Inventor: Paul Traegaardh, Tokyo, Japan

[73] Assignee: AB Tetra Pak, Lund, Sweden

[21] Appl. No.: 401,004

[22] Filed: Aug. 31, 1989

[30] Foreign Application Priority Data

Sep. 1, 1988 [JP] Japan ..... 63-220025

[51] Int. Cl.[5] ..... B32B 1/78

[52] U.S. Cl. ..... 493/309; 414/412; 414/416

[58] Field of Search ..... 414/403, 411, 412, 416, 414/788.8; 53/381 R, 458, 565; 493/309

[56] References Cited

U.S. PATENT DOCUMENTS

| | | | |
|---|---|---|---|
| 1,771,869 | 7/1930 | Baldenhofer | 53/458 X |
| 3,395,623 | 8/1968 | Baker | 53/458 X |
| 3,926,322 | 12/1975 | Scott | 53/381 R X |
| 4,571,140 | 2/1986 | Yamada et al. | 414/412 X |
| 4,696,615 | 9/1987 | Ettischer et al. | 414/416 X |
| 4,866,908 | 9/1989 | Künne et al. | 53/381 R X |

FOREIGN PATENT DOCUMENTS

| | | | |
|---|---|---|---|
| 117537 | 9/1984 | European Pat. Off. | 493/309 |
| 230704 | 12/1985 | Fed. Rep. of Germany | 414/788.8 |

*Primary Examiner*—Robert P. Olszewski
*Assistant Examiner*—Keith L. Dixon
*Attorney, Agent, or Firm*—Birch, Stewart, Kolasch & Birch

[57] ABSTRACT

A transport device for packaging container blanks includes a platform for positioning a package of a plurality of flattened packaging container blanks covered with packaging material disposed around the plurality of flattened packaging container blanks. A cutting device is provided for cutting the packaging material disposed around the plurality of flattened packaging container blanks to expose the flattened packaging container blanks for further processing. A main magazine is provided for stacking the plurality of bare blanks after removal of the packaging material. The main magazine supplies individual bare blanks, one at a time to a subsequent processing station. A robot includes a grasping member for grasping a predetermined number of bare blanks disposed on the platform and delivering the bare blanks to the main magazine.

4 Claims, 12 Drawing Sheets

20
21
22
23
25
26
26a
26b
26d
A
A'
A1
A2
a1
a2
a3

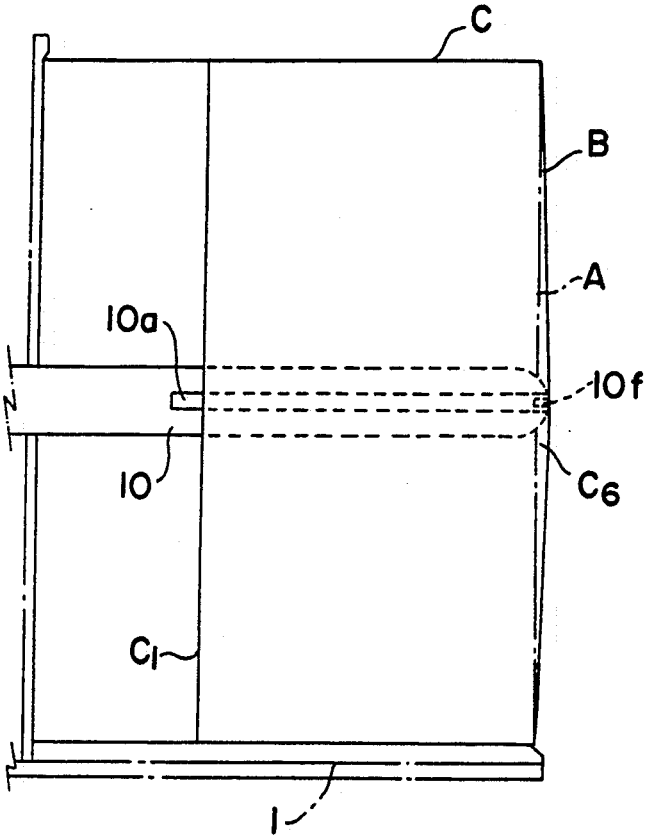
FIG. 21
FIG. 22
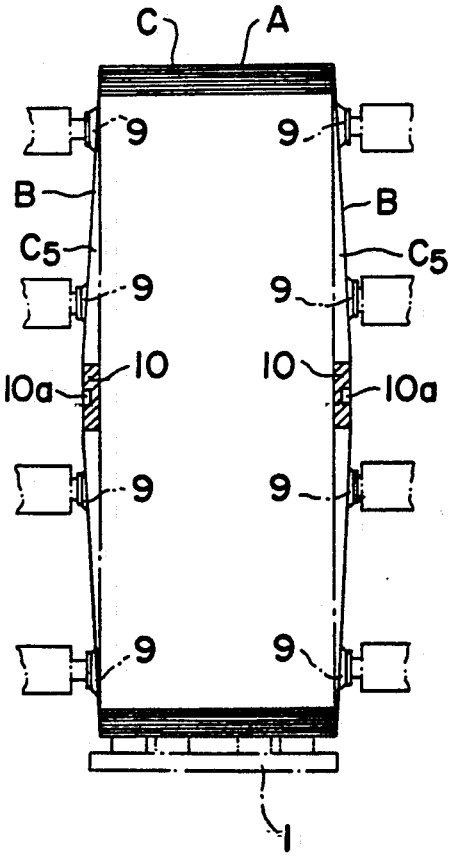
FIG. 24
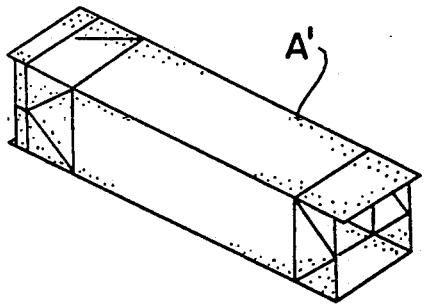
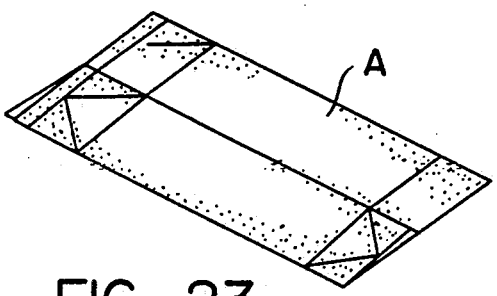
FIG. 23

TRANSPORT DEVICE FOR PACKING CONTAINER BLANKS

BACKGROUND OF THE INVENTION

1. Field of the Invention

The present invention relates to a transport device for automatically cutting and opening a package. A bundle of flattened packing container blanks, covered with packaging material on the outside, are provided for automatically supplying the blanks, after the blanks are opened, to a position relative to the cutting position of packaging material. The blanks are thereafter supplied to succeeding workstations. A series of transport devices are provided for transporting the blanks one at a time and raising the blanks into parallelepipeds with a square-shaped cross section.

2. Description of Background Art

Conventionally, various paper containers have been manufactured for a variety of uses. For example, singlelife packing containers are widely used for packaging liquid food product, such as milk and juice, and as shown in FIG. 24, some have a parallelepipedic form A'.

The blanks A for this type of packing container are invariably folded flat as shown in FIG. 23 for storage, transporting, and in order to facilitate other handling. As shown in FIG. 18, the blanks A are bundled and packaged on the outside with packaging material B.

As shown in FIG. 16, the blanks A' are raised into parallelepipedic form with a square-shaped cross section and are sent to a mandrel wheel E of the packing machine D for sealing the bottom before filling the container with liquid contents. However, in order to send the aforesaid blanks A' to a mandrel wheel E, the plurality of bare blanks A obtained by cutting and opening packaging material B of bundled package C must be supplied to a separate position removed from the cutting position and the blanks A must be transported forward while raising the blanks A into a parallelepipedic shape with a square-shaped cross section.

Hence, conventionally in most cases, the plurality of flattened blanks A are propped up on a platform before being delivered to a mandrel wheel E as shown, for example, in Japanese Pat. Pub. 62-201562.

Moreover, the cutting and opening work of packaging material B for package C involves either manual work or a device as disclosed in Japanese Pat. Pub. 62-271828. To supply a plurality of flattened blanks A to the aforesaid platform after cutting and opening also requires either manual work or a supplying device as disclosed in Japanese Pat. Pub. 62-201562.

Finally, after supplying to the platform, the flat blanks A must be raised into a parallelepipedic form with a square-shaped cross section in order to insert them in a mandrel wheel E. There is a known device that grasps a propped up blank A with a suction head and pulls it out, while at the same time forming a parallelepiped with a square-shaped cross section.

SUMMARY AND OBJECTS OF THE INVENTION

In order to prop up a plurality of flattened blanks A, at least a long horizontal platform is necessary. Thus, horizontal width of the equipment becomes equally long. Consequently, the equipment becomes disadvantageously large.

The supply of a plurality of bare blanks A after opening onto the platform becomes considerably inefficient under manual operation. Furthermore, a certain bundle of blanks A is relatively heavy and forces considerable labor upon the worker. A device developed to automate this work, as disclosed in Japanese Pat. Pub. 62-201562, has an unexpectedly complex structure and also requires detailed operation.

In addition, when applying the flat blanks A supplied to the platform one at a time to the mandrel wheels E using the conventional raising device, the initial folding tendency remains to make the formation of a square difficult. Thus, insertion to the mandrel wheels E does not proceed smoothly.

Incidentally, devices for automatically cutting and opening a package C of bundled flattened blanks A and covered on the outside with packaging material B and devices to automatically supply the plurality of bare blanks A after opening to a separate location from the cutting position have been individually developed. However, an ideal transport device that maximizes the characteristics of both devices and brings them together has yet to be developed. A series of processes are necessary to form a container beginning with raising the blanks A and sending them in parallelepipedic form with a square-shaped cross section, as shown in FIG. 24, into the packing machine D, creating bottoms, and filling the liquid contents at a filling area H. It is necessary for a device to handle a plurality of bare blanks A after opening which must be sent from some origin and automatically raised into parallelepipedic form with a square-shaped cross section and then sent to the packing machine. Conventional devices lacked reliability and were thus insufficient.

The present invention proposes to furnish a transport device closest to the ideal device that eliminates the above problems.

The transport device of the present invention consists of a platform for placing a package C, which is a bundle of a plurality of flattened packing container blanks A covered with packaging material B on the outside. A device is provided for cutting and opening the packaging material B of the package C on the platform. A main magazine stacks the plurality of bare blanks A after opening and supplies the blanks one at a time to the next process. A robot is provided for grasping the blanks A and moving the blanks to the platform after the blanks are opened from the main magazine.

In addition, the transport device is equipped so that at the front of the main magazine where a plurality of opened, bare blanks A are stacked in order to supply them one at a time to the next process, a lifting conveyor is placed in order to send in one flat blank A taken from the main magazine through a pair of discharging rollers. At the front of the pair of discharging rollers, a raising device is provided consisting of a front-and-back pair of members for supporting and constructing both rim edges of one, flat blank A that passes through the pair of discharging rollers into a parallelepiped with a square-shaped cross section. The aforesaid platform preferably can move either up or down to the opening position after cutting packaging material B of the package C on the platform.

In addition to the aforesaid main magazine, it is preferably to provide a separate storage magazine whereby the aforesaid robot can move between the platform, main magazine, and storage magazine.

The package C bundled with packaging material B, as shown in FIG. 18, is placed on the platform at the cutting position shown by chain line in FIG. 3.

The packaging material B covering the outside of the plurality of flattened blanks A is cut at this position, and the cut packaging material B is opened, for example, as shown in FIG. 17(*g*).

The plurality of bare blanks A after opening remain on the platform shown by the chain line in FIG. 13. The robot with a means of grasping comes over to pick up the plurality of blanks A on the platform, as shown by the solid line in FIG. 13. The robot proceeds to grasp the plurality of bare blanks A after opening as shown in FIG. 17(*b*).

Next, the robot moved from the solid-line position of FIG. 1 to the location of the main magazine, and inserts the plurality of bare blanks A into the main magazine at that position as shown in FIG. 17(*i*).

In this way, merely supplying a package C bundling a plurality of blanks A covered with packaging material B to the platform enables automatic cutting and opening of packaging material B and automatic supply of the plurality of bare blanks A after opening to the main magazine.

After cutting the packaging material B, if the platform with the package C moves either up or down to the opening position to differentiate between the cutting position and opening position of packaging material B, the use of vertical space can be maximized.

By placing a storage magazine separate from the main magazine whereby the aforesaid robot can move between the platform, main magazine, and storage magazine, the blanks A remaining in the main magazine can be stored in the storage magazine if the succeeding manufacturing line stops. Fast exchange between different sizes and types of blanks can take place between the main magazine and storage magazine.

The plurality of blanks A supplied to the main magazine can be taken out one at a time from the main magazine with a suction pad. Thereafter, a lifting conveyor supplies the blanks A taken out of the main magazine to a pair of discharging rollers, as shown in FIG. 14. One flattened blank A delivered from the discharging rollers has both its front and rear edge rims supported by a pair of members, as shown in FIGS. 15(*a*)–(*d*). The blank A is finally raised into a parallelepipedic form with a true square-shaped cross section, as shown in FIG. 15(*d*). Thus, as shown in FIG. 16, the blank A′ can be sent to the mandrel wheel E for the following bottom-forming process, and enables smooth loading onto the mandrel wheel E.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIGS. 15(*a*), 15(*b*), 15(*c*), and 15(*d*) are side views in order of processing for the raising operation with this raising device;

FIG. 21 is an enlarged side view of vertically cutting the two mutually opposing planes of the package and of inserting the plates from those cuts;

FIG. 22 is a profile view of the embodiment illustrated in FIG. 21;

FIG. 23 is a diagonal view of the flattened blanks;

FIG. 24 is a diagonal view of the parallelepipedically raised conditions with square-shaped cross sections.

DETAILED DESCRIPTION OF THE PREFERRED EMBODIMENTS

A preferred embodiment of the present invention will now be described with reference to the accompanying figures.

Figures 17, 18, 19:
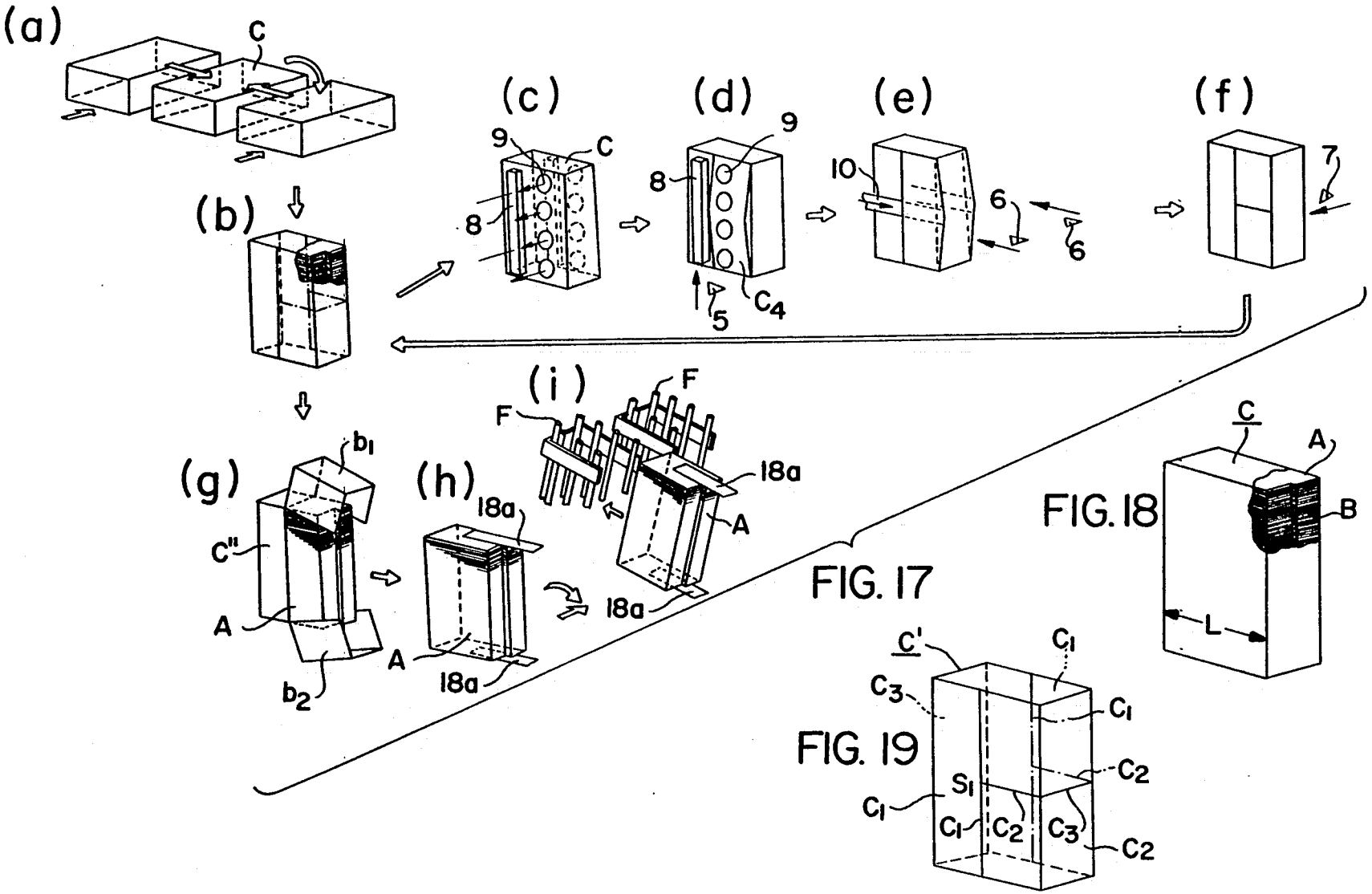
FIGS. 17(*a*)–(*i*) are diagonal views in processing order of cutting and opening the package sent by the conveyor, of removing only the content blanks, and of supplying the blanks to the main magazine.
FIG. 18 is a diagonal view of only the package.
FIG. 19 is a diagonal view of the cutting positions of the package.

Among packing container blanks, there are parallelepipedic forms with square-shaped cross sections as shown in FIG. 24. This type of blank A', however, is invariably folded as a flat blank A, as shown in FIG. 23, for storage and transporting and in order to facilitate other handling. Many of the blanks are bundled and covered on the outside, as shown in FIG. 18, with packaging material B.

In the package C, only the blanks must be sent to the succeeding manufacturing line. Therefore, the packaging material B covering the outside must be cut and opened. This operation takes place on the platform for this invention. The platform 1 is shown in FIGS. 3, 4, 12, and 13. The package C is placed on the platform 1.

Figure 3:
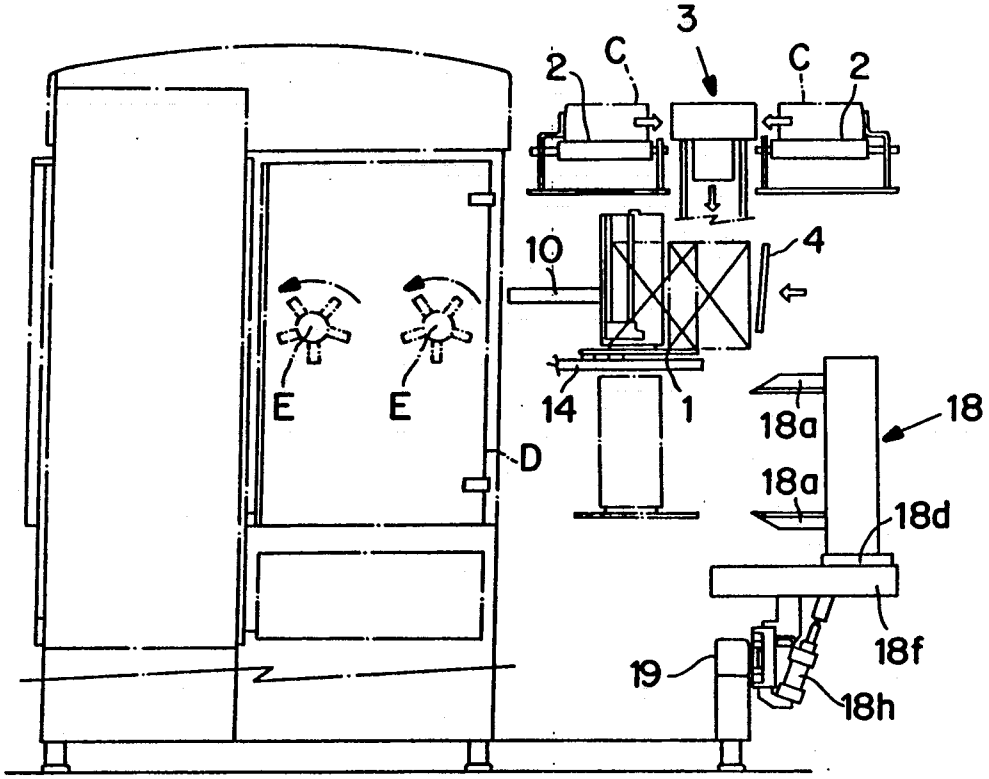
FIG. 3 is a side view of the transport device illustrated in FIG. 1 as viewed along line III—III.
Figure 9:
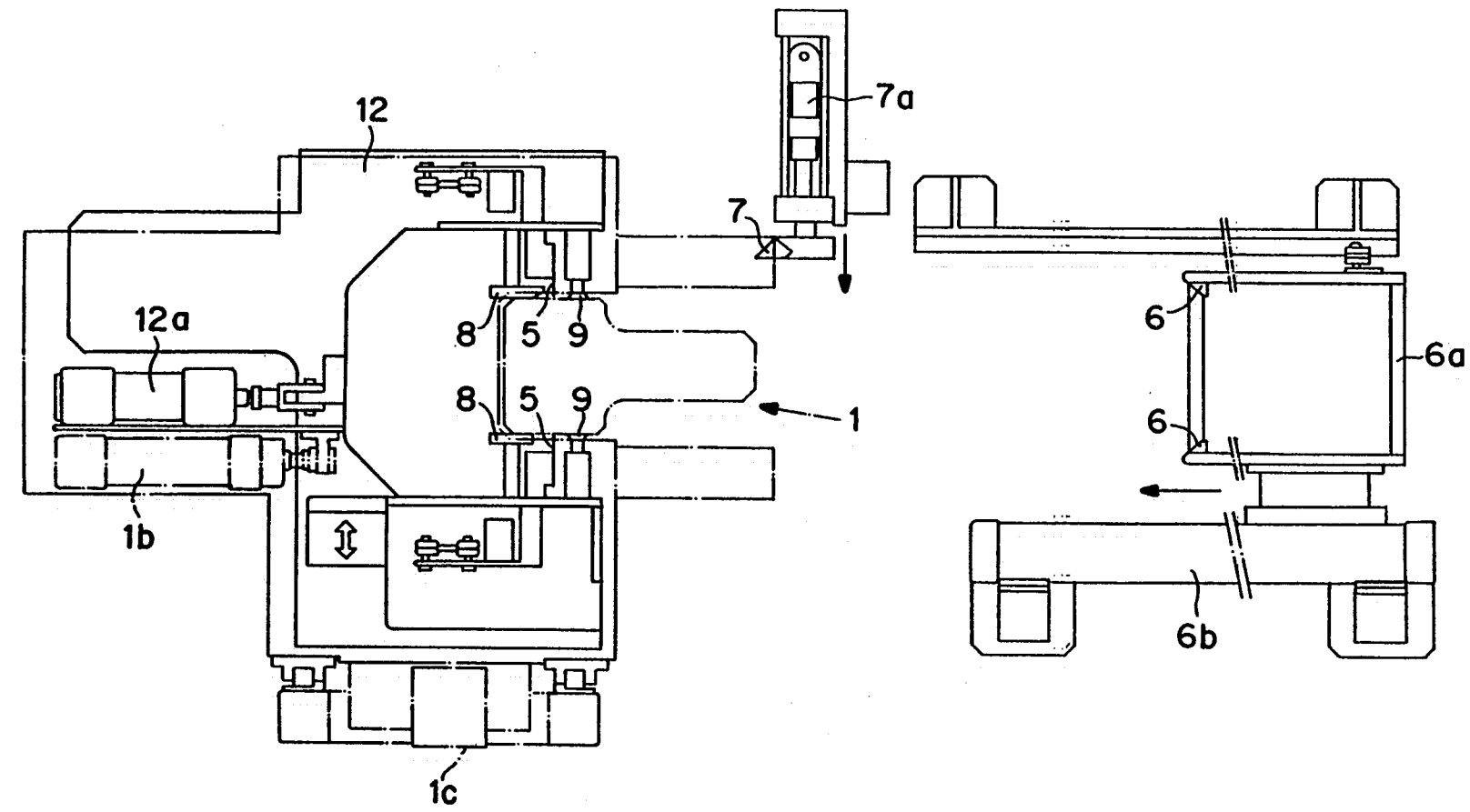
FIG. 9 is an abbreviated planar view of the entire packaging material cutting device for the package.

In this embodiment, two conveyors 2, 2 feed in the package C, as shown in FIGS. 3 and 9, and either alternately or continuously from one side push the package out to the transport device 3 located between the two conveyors 2,2. As shown by the single-dot chain line in FIG. 6, the transport device rotates and then, as shown by the two dot chain line, lowers, and finally, the package is pushed onto the platform 1 by pusher 4 shown in FIGS. 6 and 7. Automatic supply of the package C to the two conveyors 2, 2 is enabled by installing a selective supplying device (not illustrated) that can lift a package C on a palette and supply the two conveyors 2, 2.

Figure 6:
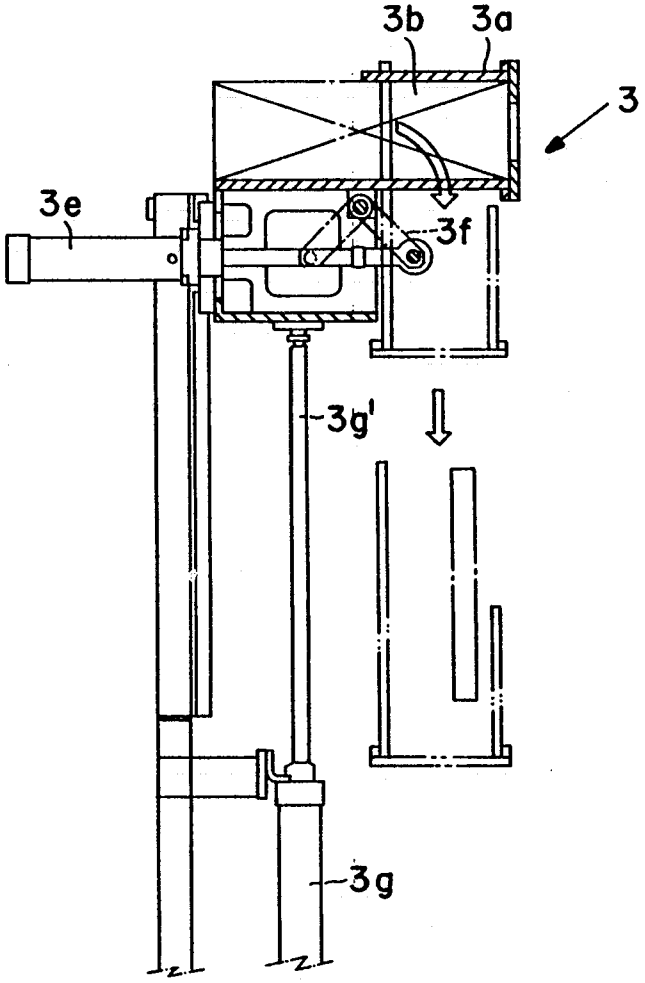
FIG. 6 is a profile view of FIG. 5 taken along line VI—VI.
Figure 5:
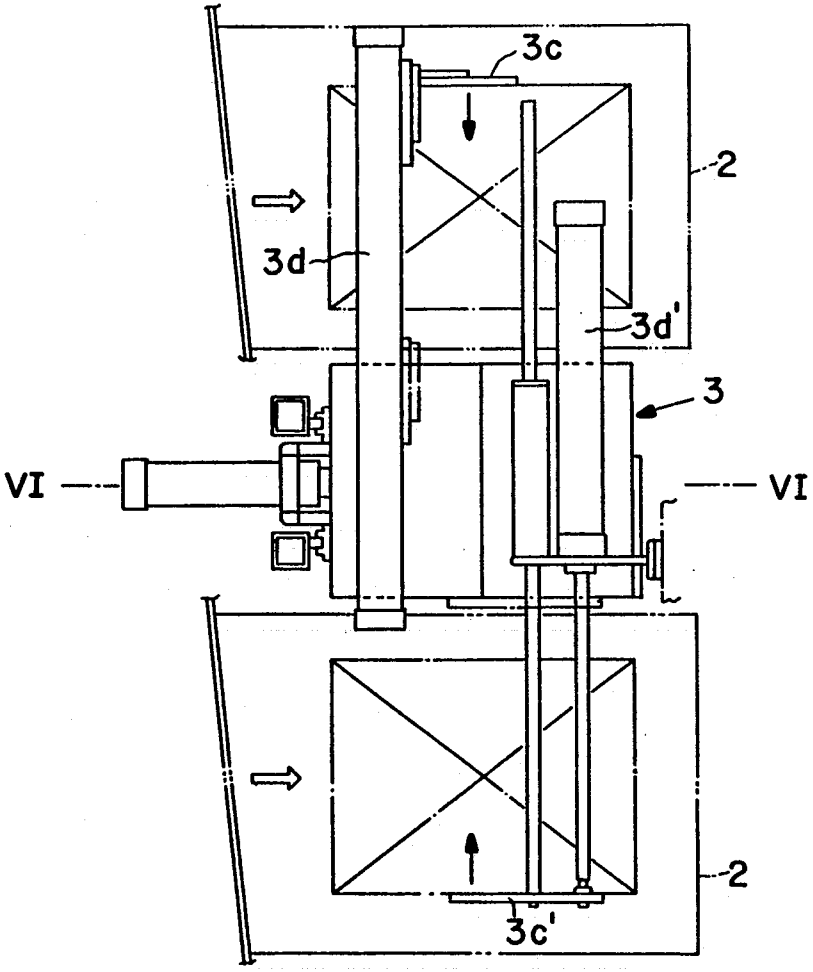
FIG. 5 is an enlarged planar view of only the package transporting device.

The transport device 3 is equipped with a storage box 3*a* that has a sideways L-shaped cross section as shown in FIG. 6, and the package C sent by the two conveyors 2,2 is pushed either alternately or continuously from one side into the storage box 3*a* from the two openings 3*b* and appear on the left and right in FIG. 3. To alternately push the package C into the storage box 3*a*, for example, pushers 3*c*, 3*c*' can be positioned above the two conveyors 2, 2 as shown in FIG. 5. The package C can be alternately moved from the solid-line position to the chain-line position of FIG. 5 by the cylinder 3*d* of pusher 3*c* and the cylinder 3*d*' of pusher 3*c*'. In order to continuously feed packages C to the storage box 3*a* from one of the two openings 3*b*, only one of the two cylinders 3*d*, 3*d*' shall be operated and the other cylinder shall be stopped.

The storage box 3*a* can rotate as shown in FIG. 6 from the solid-line position to the single-dot chain-line position, and lowered to the two-dot chain-line position retaining its orientation as shown in FIG. 6. To rotate the storage box 3*a* from the solid-line position to the single-dot chain-line position, for example, the storage box 3*a* can be joined to the end of the rod of the cylinder 3*e* with a lever 3*f*. When the rod of the cylinder 3*e* pulls in from the solid-line position shown in FIG. 6, the storage box 3*a* rotates 90 degrees from a horizontal position via the lever as shown by single-dot chain line in FIG. 6.

To lower the storage box 3*a* , while retaining its orientation to the position indicated by the two-dot chain line in FIG. 6, the storage box 3*a* can be joined directly to the rod 3*g*' of the cylinder 3*g* for moving the storage box up and down, for example. In this way, the package C delivered by the two conveyors 2,2 can be either alternately or continuously supplied from one side pushed into the storage box 3*a* . The orientation of the package C can be rotated 90 degrees and lowered to the position shown by the two-dot chain line in FIG. 6. At the lowermost position of the transport device 3, a pusher 4, shown in FIG. 3 is installed. The pusher 4 operates from one of the two openings 3*b* of the aforesaid storage box 3*a* to the other, i.e., from the right to the left in FIG. 7, and enables the package C to be pushed out from the storage box 3*a*.

In this embodiment, at the lowermost position of the storage box 3*a*, the aforesaid platform 1 is waiting and is designed so that a portion of the package C lowered from the storage box 3*a* lands on the platform 1. Hence, the pusher 4 can immediately push the package C lowered from the storage box 3*a* onto the platform 1. Until the storage box 3*a* lowers, the pusher remains tilted as shown by the solid line in FIG. 7. However, right before ending the lowering motion of the storage box 3*a*, a cylinder 4*a* renders the pusher vertical as shown by the chain line in FIG. 7. While acting as a guide, another cylinder 4*b* retains the orientation and the pusher moves to the left of FIG. 7, effectively pushing the package C out of the storage box 3*a* onto the platform 1.

The cutting and opening of the packaging material B of the package C on the platform 1 has been discussed. An embodiment of this device will now be described.

Figure 8:
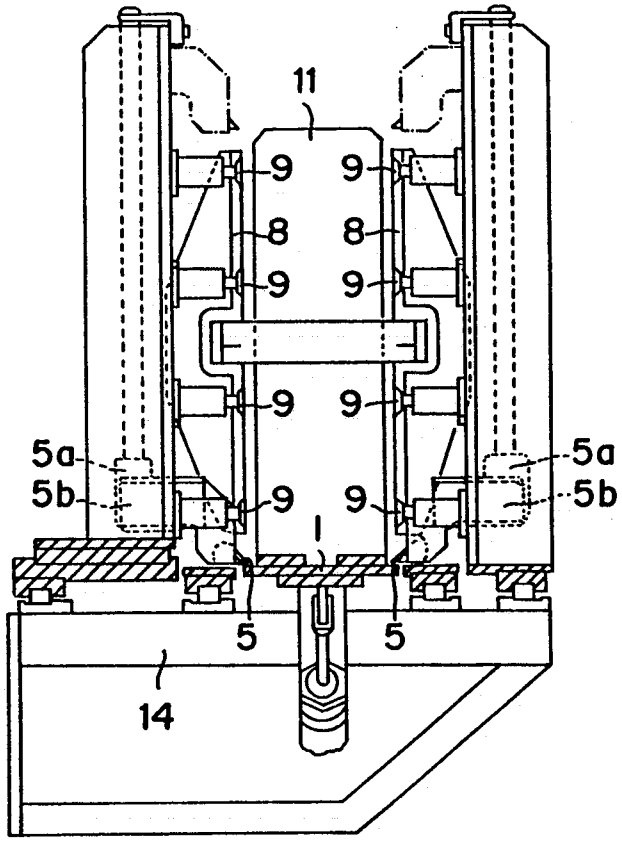
FIG. 8 is an enlarged front view of only the platform of the packaging material cutting device for the package.

The packaging material B can be cut by applying and imparting motion to thin cutting blades on the packaging material B. In this embodiment, the position of applying the cutting blades on the packaging material B around the plurality of blanks A in FIG. 19 are along the vertical lines shown by $c_1$ on the two mutually opposing perpendicular planes C1, C1, along the symmetrical horizontal lines $c_2$ from $s_1$ to the perpendicular plane C2 that intersects perpendicularly with the two surfaces C1, C1, and along the connecting horizontal line $c_3$ between $c_2$ and $c_2$ on plane C2. Cutting blades are positioned to the side of the package C on the platform 1 in order to cut this portion of the packaging material B. The cutting blades 5 for cutting the vertical portion c1, c1 of the packaging material B are shown in FIG. 8. The cutting blades 6 for cutting the horizontal portion $c_2$, $c_2$ are shown in FIG. 9. The cutting blade 7 for cutting the connecting horizontal portion $c_3$ between $C_2$ and $C_2$ is shown in FIG. 9.

Cutting blades 5, 5 are arranged as a pair on the left and right in FIG. 8. Cylinders 5*a*, 5*a* are located on the side of the platform 2 for moving the cutting blades 5, 5 up and down. By applying the left and right pair of cutting blades 5, 5 to the package C on the platform 1 and running the blades along from the solid-line position of FIG. 8 to the chain-line position in FIG. 8, the portion $c_1$, $c_1$ of the packaging material B of the package C indicated in FIG. 19 can be cut. In addition in FIG. 5, cutting blades 5 have separate cylinders 5*b* installed in order to move to the left and right separately from the cylinders 5*a*. The cylinders 5*b* place cutting blades 5 temporarily in the back relative to the platform 1, as illustrated in the left and right outer sides of FIG. 8. Thereafter, the cutting blades 5 are advanced to the solid-line position in FIG. 8 in order to cut packaging material B. After cutting, the cutting blades 5 are returned by the cylinders 5*b*, and lowered by the cylinders 5*a*.

The cutting blades 6 in FIG. 9 are positioned so they emerge symmetrically vertical and advance to the left when facing the platform 1 from the solid-line position in FIG. 9. The portion $c_2$, $c_2$ of the packaging material B of the package C on the platform 1 indicated in FIG. 19 can be cut. As a means for the pair of cutting blades 6, 6 to approach the platform and to return to the solid-line position in FIG. 9 after cutting the packaging material B, the embodiment employs a cylinder 6*b* for moving a frame 6a mounting the cutting blades 6, 6 to the left and right.

The cutting blade is positioned as shown in FIG. 9. By advancing from the solid-line position in the direction of the arrow, the portion $c_3$ of the packaging material B of the package C on the platform as indicated in FIG. 19 can be cut. As a means for the cutting blade 7 to advance and to return to the solid-line position in FIG. 9 after cutting the packaging material B, the embodiment employs a cylinder 7a for moving the cutting blade 7 up and down in FIG. 9.

When performing the aforesaid cuts, the preferred embodiment creates a space $c_5$ between the rim edges of the blanks A that are packaged so the package C on the platform 1 does not move. Thus, applying and running the aforesaid cutting blades 5 along the packaging material B does not injure the blanks A of the package C, while the package C remains held by holders 8, 8 and does not slip.

The portion $c_1$ cut by cutting blades 5 is in an open-mouth form. As shown in FIG. 17(e), ruler-like plates 10 are inserted into this portion. The plates 10 can be placed in the space $c_5$ as shown in FIG. 22 between the packaging material B pulled outward by suction pads 9, 9 and the packaged blanks A. Thus, when cutting the portion $c_2$, $c_2$ as shown in FIG. 19, the plates 10 can be underlays to prevent injury to the rim edges of packaged blanks A. The outer surfaces of plates 10 should include longitudinal slots 10a. In this way, if the blade tips stay within the slots 10a when the aforesaid cutting blades 6 are moved along horizontally and cut the packaging material B, the blade tips do not fluctuate and the cutting position of packaging material B does not slip.

The ends of the inserted plates 10 from the cut portion $c_1$ of the package C stick outward from the other perpendicular plane C2 of the package C as shown in FIGS. 17(e) and 21. Thus, a space $c_6$ forms between packaging material B and rim edges of the packaged blanks A as shown in FIG. 21. In this way, cutting packaging material B on plane C2 by cutting blade 7 does not injure the rim edges of packaged blanks A. As shown in FIG. 21, if a slot 10f is formed on the ends of the plates 10, so that the blade tip stays within the slot 10f when the aforesaid cutting blade 7 runs along horizontally and cuts the packaging material B, the blade tip does not fluctuate and the cutting position of packaging material B does not slip.

Figure 7:
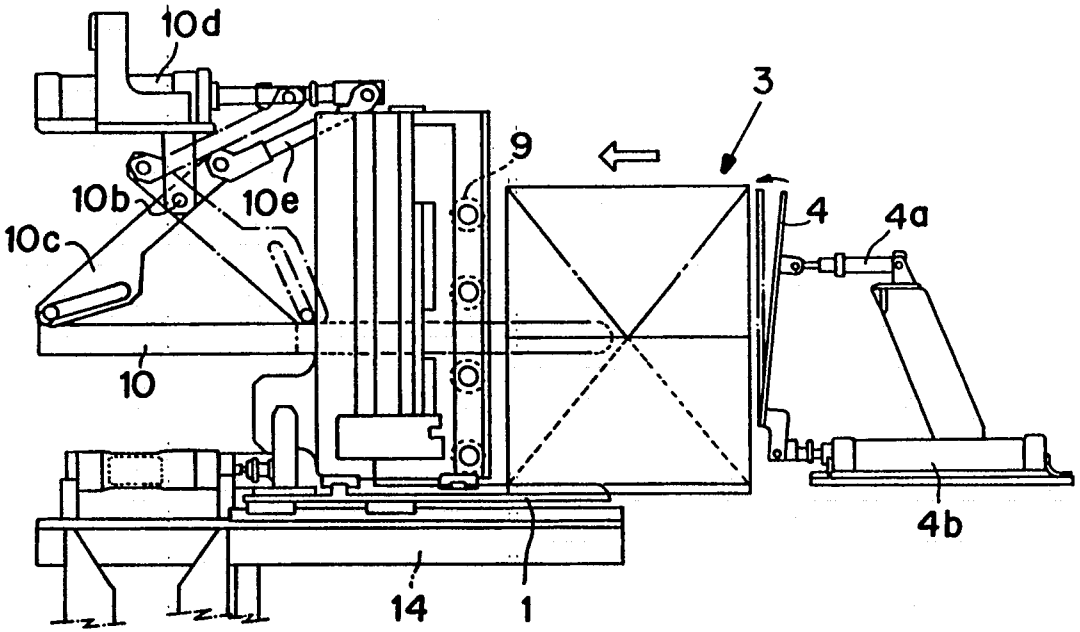
FIG. 7 is an enlarged side view illustrating the relationship between the platform of the packaging material cutting device and the pusher that pushes the package onto the platform.

Regarding the insertion of plates 10 shown in FIG. 17(e) from the portion $c_1$ cut by cutting blades 5 along plane C1 of the package C, for example, one end of the oscillating lever 10c centered around the pivoting axis 10b, as shown in FIG. 7, can be joined to the plates 10. The other end of said lever 10c may be connected to the end of a rod of the cylinder 10d with a lever 10e. When the rod of the cylinder 10d, shown with solid lines in FIG. 7, is reciprocated in, the lever 10c oscillates around pivoting axis 10b via the lever 10e, as shown by the chain line in FIG. 7. Thus, the plates 10, shown with solid lines in FIG. 7, advance to the right in FIG. 7 as the chain line shows, and are successively inserted from the ends of the package C.

Figure 12:
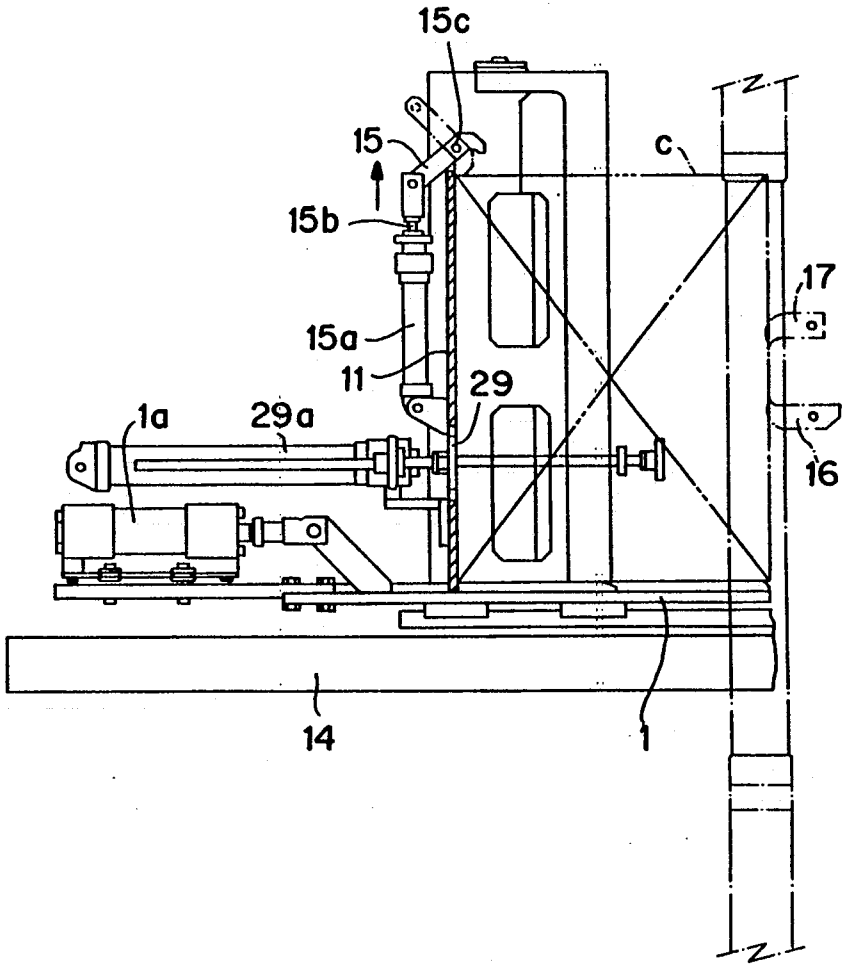
FIG. 12 is an enlarged side view of the opening device combined with the cutting device after the package is cut.

When performing the respective cutting operations described above, a back plate 11 is installed on the left side relative to FIG. 12 toward the back of the platform 1 in order to determine the position of the package C on the platform 1. During the respective cutting operations described above, the back plate 11 should be aligned with a plane C3 of the package C as illustrated in FIG. 19.

Figure 10:
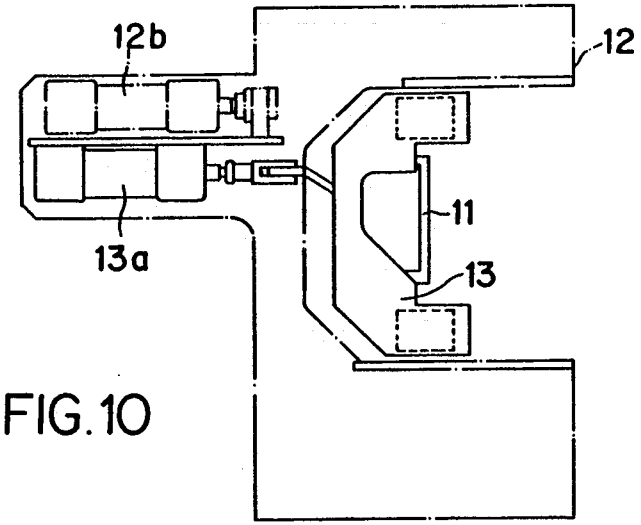
FIG. 10 illustrates a positional relationship between the two platforms above the platform which is part of the packaging material cutting device for the package.

The holders 8 and suction pads 9 are on a separate platform 12 above the platform 1, as shown in FIG. 9. The back plate 11 is also on a separate platform 13 above the platform 12, as shown in FIG. 10. The platform 1 can move relative to the frame 14 with a cylinder 1a, as shown in FIG. 12. The platform 12 can move relative to the platform 1 with a separate cylinder 1b mounted on the platform 1 and with a cylinder 12a mounted on the platform 12 as shown in FIG. 9. The platform 13 can move relative to the platform 12 with a separate cylinder 12b mounted on the platform 12 and with a cylinder 13a mounted on the platform 13 as shown in FIG. 10. By appropriate control of the cylinders whereby all are operated or part of them are not, the amount of movement of the platforms 1, 12 and 13 and the mutual positional relations between the platforms can be freely modified. In this way, even in the event that the length of blanks A or the length L, as illustrated in FIG. 18, of the package C of the blanks A bundled with the packaging material B differs according to a difference in volume, by providing a constant position of one plane C2 for each package before placing on the platform 1, for example, the platform 1 position to support one package, the cutting blades 5 position, the holders 8 position, the suction pads 9 position, and the back plate 11 position can be freely modified according to the length of the package. This means that when the package to be cut has a different length, the supporting platform 1 meets the package at the prescribed location and the cutting blades 5 can cut at the prescribed position on the mutually opposing two perpendicular planes C1, C1 for each package. In other words, even in the event of handling packages of different lengths, the packaging material B can be cut vertically at the prescribed position for each package.

In this way, the packaging material B of the package C on the platform 1 can be cut, and in this case the platform 1 is located at the solid-line position of FIG. 3. This position is the cutting position. In the preferred embodiment, the platform 1 lowers from this cutting position as shown by the chain line in FIG. 3 where the packaging material B is opened after cutting. In this way, vertical space usage is maximized and preferable. To lower the platform 1 from the solid-line position of FIG. 3 to the chain-line position of the same figure, for example, the cylinder 1c, as illustrated in FIG. 9, can be used to lower the entire platform 1 along with the frame 14.

Figure 20:
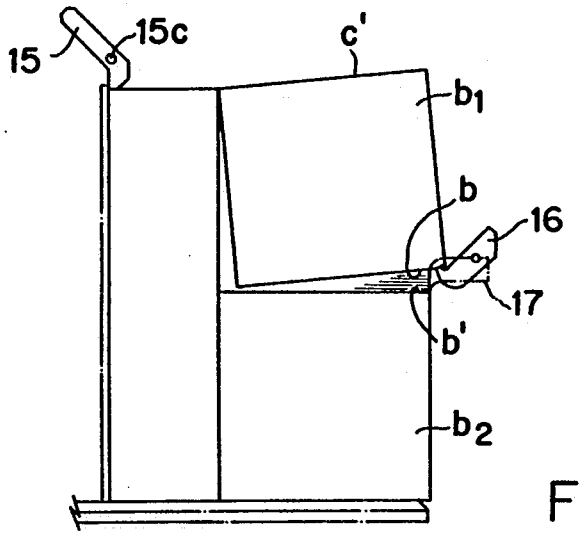
FIG. 20 is an enlarged view of the opening operation of the package after cutting.

As a means to open the packaging material B after cutting in the preferred embodiment, FIG. 12 shows a lever 15 that grasps the upper corner of cut package C', as illustrated in FIG. 19, on the platform 1. A catch 16 is movable from below in an upward direction. A catch 17 is movable from above in a downward direction. The lower end of the lever 15 is pivotally attached to the rod 15b of a cylinder 15a. According to the action of the cylinder 15a, the rod 15b extends toward the arrow direction of FIG. 12, and the rod moves from its solid-line position in FIG. 12 as shown by the chain line. Consequently, the end of the lever 15 grasps the upper corner of the package C'. Thereafter, the mouth of the cut packaging material B opens slightly as shown in FIG. 20. The end of the catch 16 enters the mouth, catches the edge of the open mouth, and rises. Thus, the upper half b1 of packaging material B opens, as shown in FIGS. 17(g) and 20. Next, the upper catch 17 lowers and an end of the upper catch catches the edge of the open mouth b' of $b_2$, as illustrated in FIG. 20, of packaging material B, and lowers the packaging material B. Thus, the lower half $b_2$ of the packaging material B opens, as shown in FIG. 17(*g*) and 20. In this way, opening proceeds for the package C' after cutting on the platform 1. This opening operation, besides the preferred embodiment, can proceed by ripping off the packaging material B after cutting by pulling on any of the planes of package C' after cutting with suction pads.

Once opened, the packaging material B becomes unneeded, and only the contents need to be taken. The contents are stored first in the main magazine F, taken out and sent one at a time to the next process, raised into parallelepipedic form with a square-shaped cross section, and finally sent to the mandrel wheels E of the packing machine D in order to form the bottom of the blanks A' now in a parallelepipedic form with a square-shaped cross section. In the present invention, a robot performs the operation consisting of removing only the plurality of bare blanks A after opening and supplying them to the main magazine F.

Figure 1:
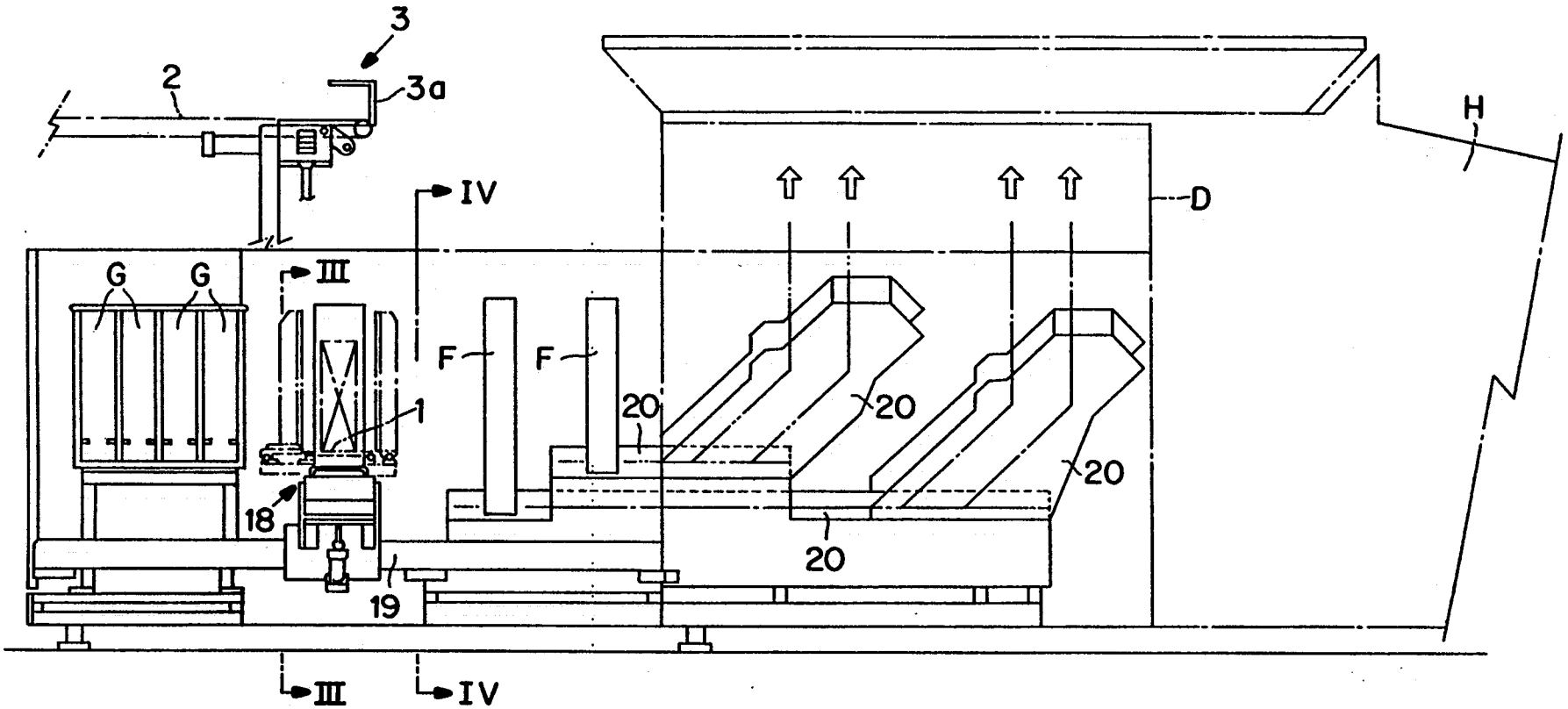
FIG. 1 is the abbreviated front view of the transport device according to the present invention.

The robot 18, as illustrated in FIGS. 1 and 3, can move at least between the platform 1 after opening and main magazine F. In the preferred embodiment, there are two main magazines F, as shown in FIG. 1. The robot 18 should run along a guide rail 19 located between the platform 1 and the two main magazines F, F.

Figure 13:
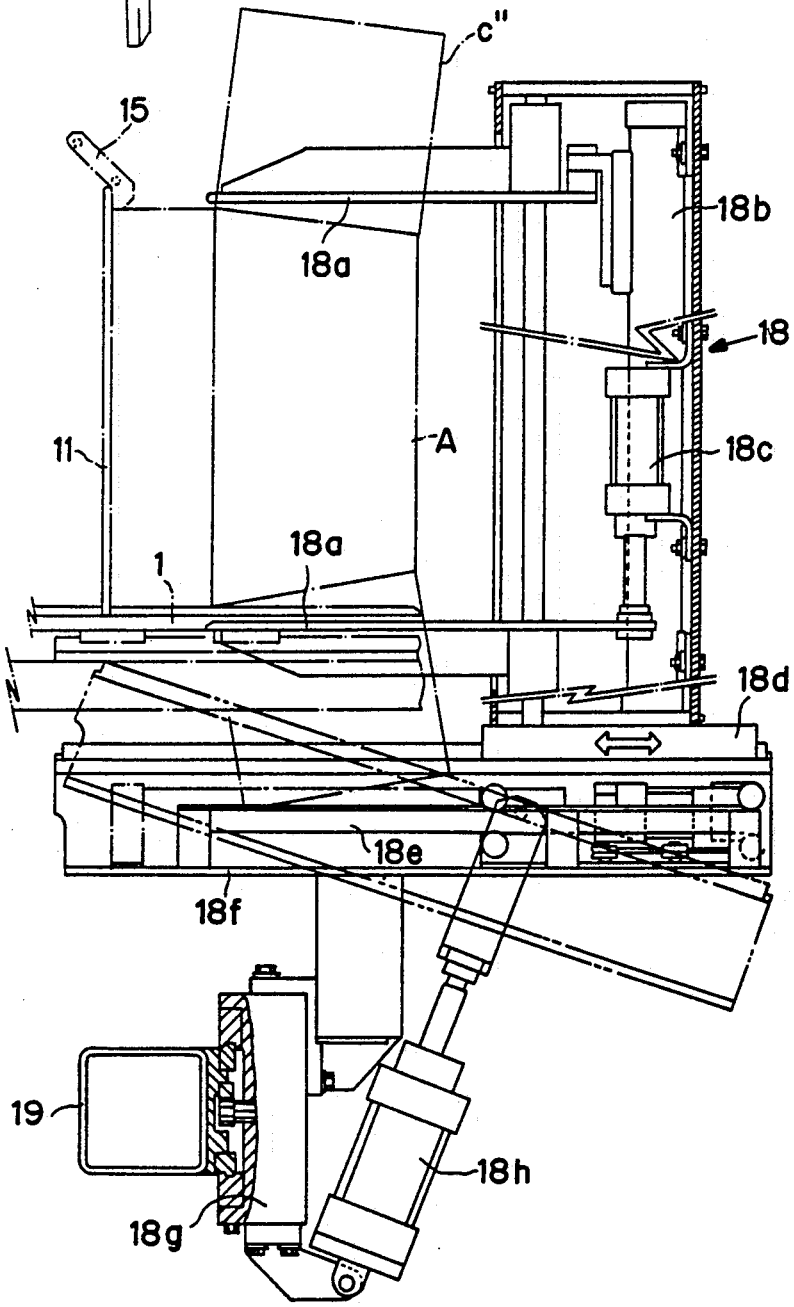
FIG. 13 is an enlarged side view of the robot with a pair of grasping members.

The robot 18 has a means of grasping formed by a pair of upper and lower forks 18*a*, 18*a*, as shown in FIG. 13, and approaches the opened package C" on the platform 1, to remove only the plurality of bare blanks A, as shown in FIG. 17(*h*) with the upper and lower forks 18*a*, 18*a* running along the guide rail 19 toward the main magazine F. The plurality of blanks A are grasped with the upper and lower forks 18*a*, 18*a* and supplied to either of the two magazines F, F as shown in FIG. 17(*i*). The upper and lower forks 18*a*, 18*a* can freely change their mutual distance with the two cylinders 18*b*, 18*c* as needed, as illustrated in FIG. 13. When removing the plurality of bare blanks A from the platform 1, supplying them to the main magazine F, and removing the remaining blanks A in the main magazine F (discussed later), the pair of forks 18*a*, 18*a* should approach and return from the platform 1 and main magazine F. To enable this, example, as shown in the preferred embodiment, the base 18*d* of the robot 18 should slide to the left from the solid-line position of FIG. 13 along the guide rail 18*e* of the rack 18*f*. This base 18*d* should be lowered to the solid-line position in FIG. 13 when it moved between the platform 1 and main magazine F.

Figure 11:
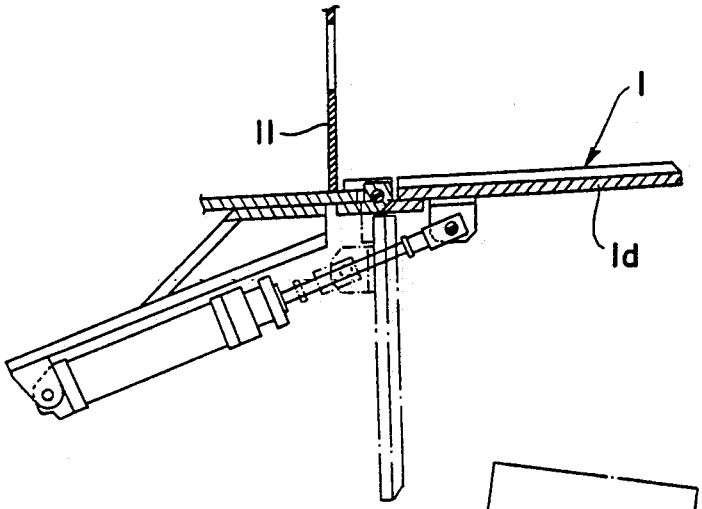
FIG. 11 is a partially cut side view illustrating the tilting of the platform which is part of the packaging material cutting device for the package.

In the preferred embodiment, the portion 1*d* in front of the platform 1 tilts as shown by the chain line in FIG. 11. In this way, the lower fork of the pair of forks 18*a*, 18*a* does not contact the platform 1 when it picks up the plurality of bare blanks A on the platform 1, and can enter the place where the said blanks are exposed outside of the packaging material B.

Again, in the preferred embodiment, there is a storage magazine G separate from the main magazine F, as shown in FIG. 1, and the aforesaid guide rail 19 extends to this position. The storage magazine G can store remaining blanks A in the main magazine F when the succeeding manufacturing line stops, or can speed up exchanges between blanks of a different size or type between the main magazine F and storage magazine G.

Figure 4:
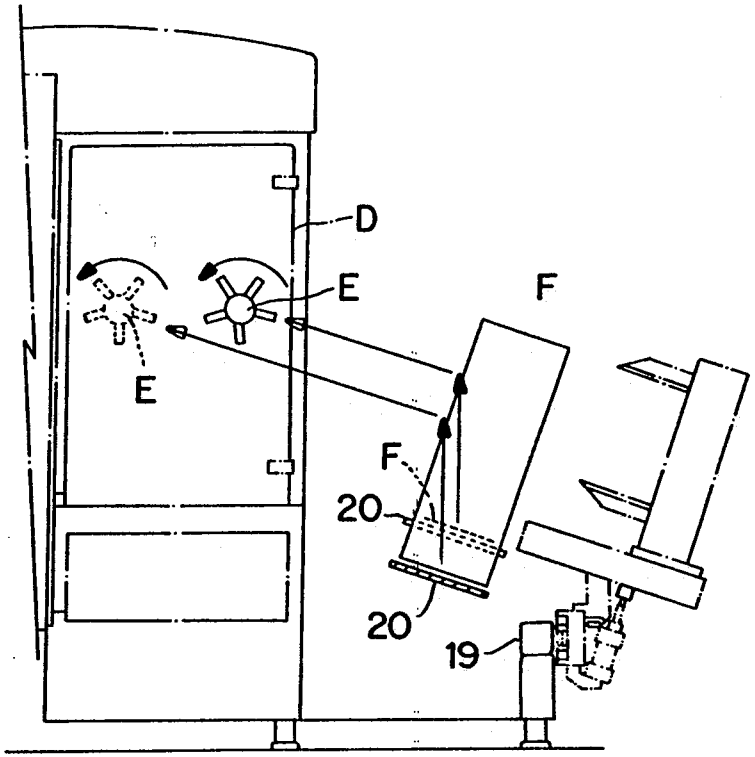
FIG. 4 is a side view of FIG. 1 as viewed along line IV—IV.

Unillustrated suction pads remove the plurality of blanks A supplied to the main magazine F by the robot 18 one at a time. The main conveyor 20 is located directly below the blanks A and sends the blanks A forward. In the preferred embodiment, there are two main magazines F. The bottom positions of the magazines F are differentiated heightwise. The continuing main conveyors 20 are also positioned in two levels, upper and lower, as shown in FIG. 4. The lower main conveyor 20 extends further than the upper main conveyor as shown in FIG. 1.

Figures 14, 15A, 15B, 15C, 15D:
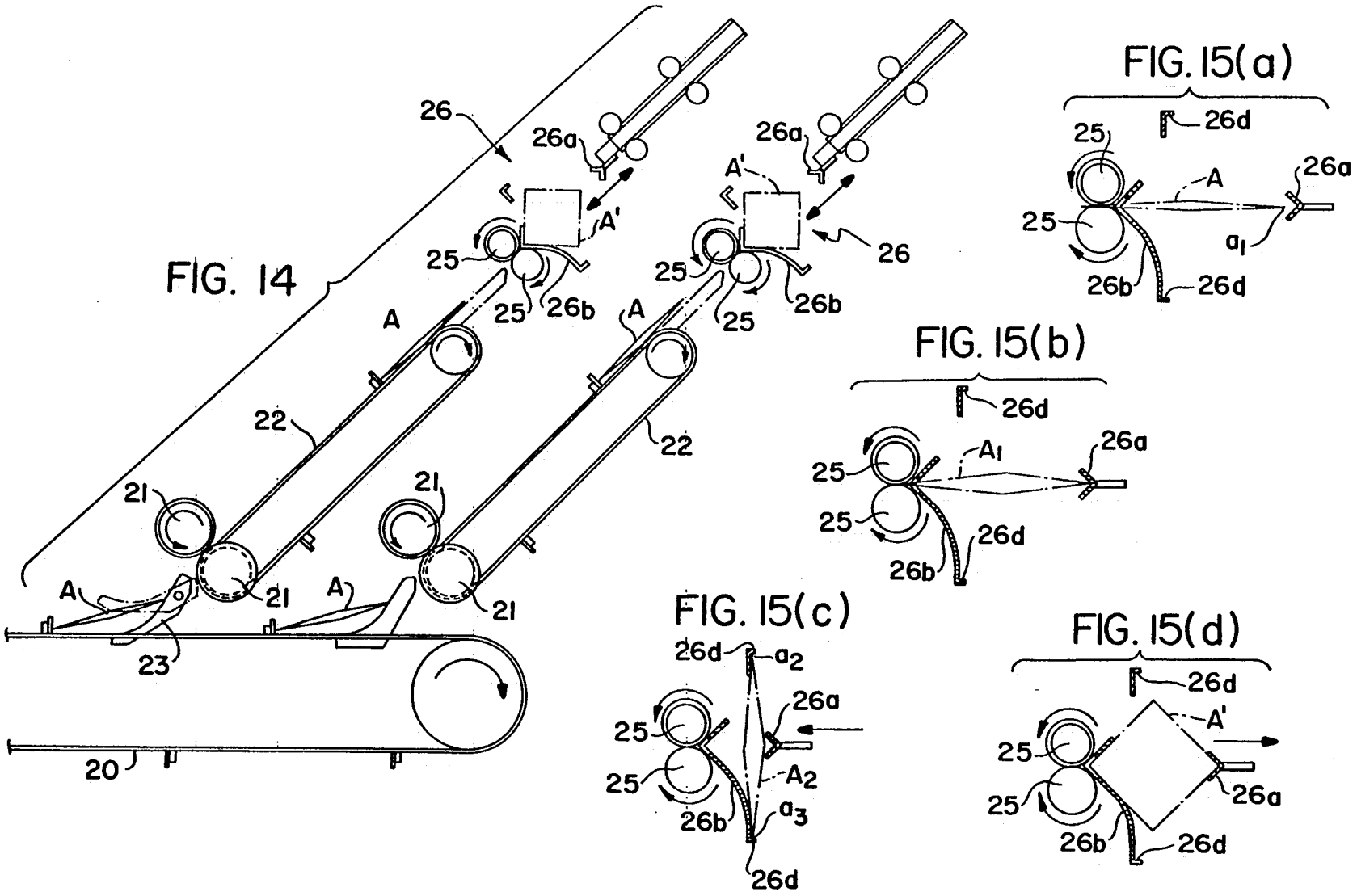
FIG. 14 is a front view of only the device that raises blanks into parallelepipeds with square-shaped cross sections, the device normally is tilted, but is shown not tilted for clarity.

Near their terminating ends, covers 20' rise 45 degrees upward relative to the advancing direction to cover the two main conveyors 20. The interior consists of a pair of charging rollers 21 followed by lifting conveyors 22 that rise 45 degrees, as shown in FIG. 14. In the case of the preferred embodiment, two sets of charging rollers 21, 21 are installed for each main conveyor 20 at the front and back, and the lifting conveyor 22 is located correspondingly. A movable guide plate 23 for guiding alternately placed, flat blanks A sent one after another from the main conveyor 20 to the lifting conveyor 23 in the front is installed near the charging rollers 21, 21 close to the main magazine F on the front, left side as illustrated in FIG. 14. A fixed guide plate 24 for guiding blanks A passed beneath the movable guide plate 23 by switching is installed near the other charging rollers 21, 21, as illustrated on the right side in FIG. 14.

When the movable guide plate 23 is in the position shown by the solid lines in FIG. 14, the movable guide plate 23 changes the transporting direction of the flattened blanks A delivered by the main conveyor 20. The blanks a pass through the first charging rollers 21, 21 to the first lifting conveyor 22. When the movable guide plate 23 is in the position shown by the chain lines in FIG. 14, the flattened blanks A delivered by the main conveyor 20 pass beneath the movable guide plate 23 and reach the fixed guide plate 24, where the fixed guide plate changes the transporting direction of the blanks. The blanks A pass through the second set of charging rollers 21, 21 to the second lifting conveyor 22. In this way, by switching the movable guide plate 23, the flattened blanks A are divided and sent from one main conveyor 20 into two streams, and sent 45 degrees upward via the respective lifting conveyors 22.

Figure 16:
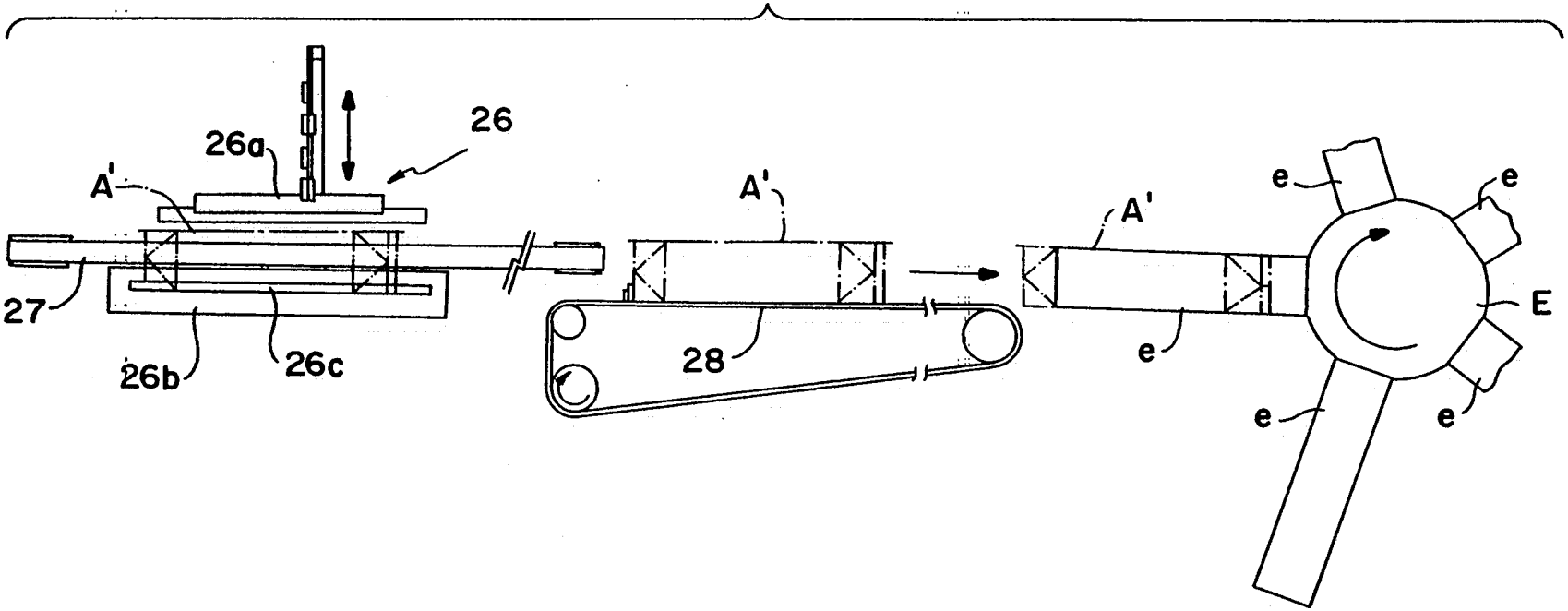
FIG. 16 is a transport route from the raising device to the mandrel wheels, showing additional blanks raised into parallelepipeds with square-shaped cross sections and inserted into the mandrels.

A pair of discharging rollers 25, 25 are located right in front of both lifting conveyors 22, followed by raising devices 26. The flattened blanks delivered by a lifting conveyor pass through a pair of discharging rollers 25, 25 and reach a raising device 26. The raising device consists of, relative to the advancing direction of the blanks A, a front-and-back pair of members 26*a*, 26*b* opened at 90 degrees. The member 26*a* mounted in the front can move forward and backward. The other member 26*b* mounted in the back right in front of the discharging rollers 25, 25 cannot move. As shown in FIG. 16, the member 26*b* that passes the blanks A through, contains a window hole 26*c*, and, as shown in FIG. 15, has a pair above and below of bearing pieces 26*d*, 26*d* separately above and below relative to the transporting direction.

The flattened blanks A sent from a lifting conveyor 22 pass between discharging rollers 25, 25 and once the great majority come out of the window hole 26*c* of the piece 26*b*, their front edge rims $a_1$ are supported by the front member 26*a* as shown in FIG. 15(*b*). When the piece 26*a* approaches as shown in FIG. 15(*c*), the front side of a blank A is pressed while the portions $a_2$ and $a_3$ are supported by bearings 26*d*, 26*d*, forming a thin rhombus momentarily. Next, by clearing the front piece 26*a* away, as shown in FIG. 15(*d*), a parallelepipedic form with a true square-shaped cross section can be raised. By momentarily forming a thin rhombus, the construction results in a parallelepipedic form with a square-shaped cross section from a flattened blank A even if the blank A has retained certain folding tendency. Constructions in this case provide smooth insertions into the mandrel wheels E of the packing machine D, more precisely a square-pillar mandrel e.

The series of devices from the movable guide plate 23 and fixed guide plate 24 to the raising device 26 are covered with a cover 20'. The blanks A' raised in square parallelepipedic form while passing through are shipped out of the cover 20' perpendicular to the paper surface in FIG. 14 by an unloading conveyor 27 and delivered to the right side of FIG. 16. The blanks A are further delivered to the right side of FIG. 16' by the loading conveyor 28.

In this way, the flattened blanks A removed from the main magazine F are sent via the main conveyor 20, a pair of charging rollers 21, 21, a lifting conveyor 22, and a pair of discharging rollers 25, 25, to the raising device that constructs the blanks into parallelepipeds with square-shaped cross sections. The blanks A are further sent via an unloading conveyor 27 to a loading conveyor 28. By directly connecting the series of transport devices to the packing machine D up to the loading conveyor 28, the flattened blanks A taken one at a time from the main magazine F can be raised into parallelepipedic form with a square-shaped cross section and automatically supplied to the packing machine D.

Figure 2:
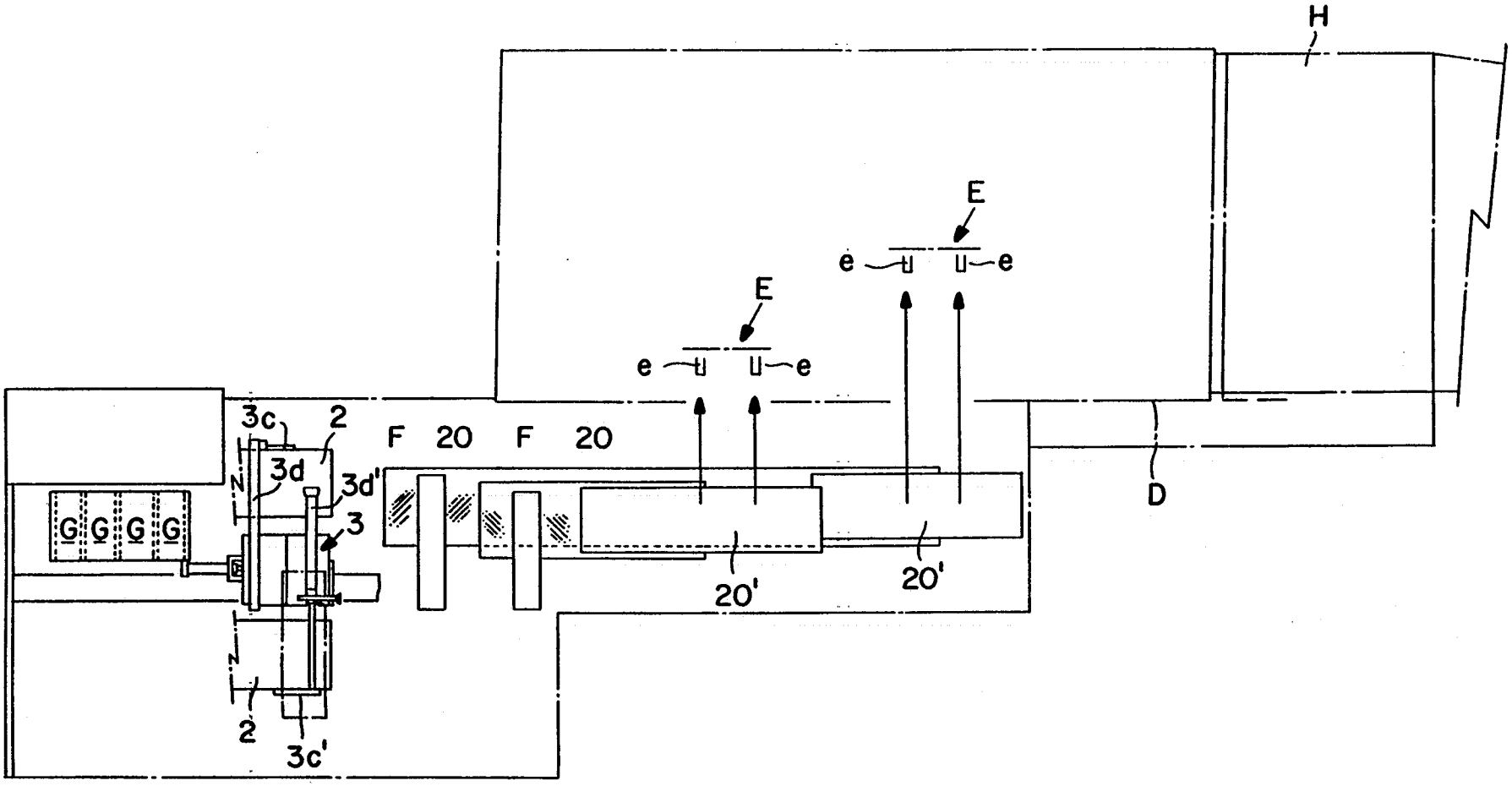
FIG. 2 is a planar view of the transport device illustrated in FIG. 1.

The entrance of the packing machine D is equipped with the mandrel wheels E shown in FIGS. 2–4. One blank A' in parallelepipedic form with a square-shaped cross section delivered from the loading conveyor 28 is inserted into a mandrel e of a mandrel wheel E as shown in FIG. 16. The bottom of the blank A' is created during the time the mandrel e rotates in the direction of the arrow, as illustrated in FIG. 16. The carton with its formed bottom is taken off the mandrel e, delivered to the filling area H and filled with liquid contents, sealed at the top, and finally delivered from the unit.

As shown in the preferred embodiment, by furnishing two main magazines F and placing the series of devices described above for each main magazine F, two sets of mandrel wheels E shown in FIG. 4 with solid lines and chain lines can be systematically supplied with blanks A' in parallelepipedic form with square-shaped cross sections. By placing two sets of a pair of charging rollers 21, 21 of a lifting conveyor 22, of a pair of discharging rollers 25, 25, of a raising device 26, of an unloading conveyor 27, and of a loading conveyor 28, two rows, left and right, of mandrels e, e on one mandrel wheel E can be systematically supplied as shown in FIG. 2 with blanks A' raised in parallelepipedic form with square-shaped cross sections. Since the supply can continue one after another, efficient and continuous manufacture of product proceeds by forming the bottom, filling the liquid contents, and sealing the top.

The two main magazines F, F in the preferred embodiment both tilt approximately 18 degrees relative to the horizontal as shown in FIG. 4. The main conveyors 20, 20 also tilt approximately 18 degrees in a corresponding fashion. Moreover, the continuing pair of charging rollers 21, 21, the lifting conveyor 22, the pair of discharging rollers 25, 25, and the raising device 26 all tilt in accordance with the main conveyor 20. In addition, the unloading conveyor 27 for exporting the blanks A' which are raised in parallelepipedic form with a square-shaped cross section and the loading conveyor 28 further ahead also tilt approximately 18 degrees to the horizontal as shown in FIG. 16. This tilt matches the tilt of the mandrel e where the blanks A' are raised in parallelepipedic form with square-shaped cross sections and are inserted into the mandrels e. In this way, the raised blanks A' can be directly inserted into the mandrels e.

In order to automatically supply the plurality of blanks A after opening to the main magazine F tilted approximately 18 degrees, the robot 18 forks 18*a*, 18*a* should also be tilted approximately 18 degrees. In the preferred embodiment, the robot 18 rack 18*f*, as shown in FIG. 13 by the chain lines, is entirely tilted. The rack 18*f* on the platform is horizontal when the plurality of bare blanks A are removed from the platform 1. However, the rack 18*f* tilts later as shown by the chain lines in FIG. 18 and supplies to the main magazine F location. In order to tilt the rack 18*f* as shown in FIG. 13, for example, a cylinder 18*h* can be mounted to the main base 18*g* which is tilted along the guide rail 19 and the end of the rod can be connected to the rack 18*f*. By operating the cylinder 18*h* so that the cylinder 18*h* rod can pull in, the rack 18*f* can be tilted relative to the main base 18*g*. By operating the cylinder 18*h* in reverse, the rack 18*f* can return to a horizontal orientation.

As illustrated in FIG. 12, pusher 29 is operated to push out packaging material which is then a shell after the plurality of blanks A are removed by the pair of forks 18*a*, 18*a*. The pusher 29 can advance to the chain-line position from the solid-line position in FIG. 12 according to cylinder 29*a* movement. The packaging material shells pushed out by the pusher can be disposed of with a suitable, unillustrated device.

According to the present invention, a package of a plurality of bundles of flattened blanks for packing containers A is cut and opened automatically on a platform. Only the contents which are a plurality of blanks A are automatically taken out and automatically supplied to the main magazine. Thus, the series of transporting operations are completely unmanned and quite efficient. Since the plurality of flattened blanks A can be stored in a stacked fashion at the main magazine, the horizontal width of the unit can be small compared to conventional devices that propped up the blanks.

According to the present invention, the flattened blanks A can be definitely raised into parallelepipedic form with a square-shaped cross section. In addition, the blanks A can be loaded smoothly into mandrels. Thus, packing machine D breakdowns due to misinserting mandrels becomes virtually nonexistent, and product manufacturing efficiency improves dramatically.

According to the present invention, vertical space use is maximized. Therefore, the transport device can be made smaller.

According to the present invention, blanks remaining in the main magazine can be automatically returned to the storage magazine or blanks of different size or type can be quickly exchanged between the main magazine and storage magazine when needed for use. The unmanned operations are greatly enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A transport device for packaging container blanks comprising:

vertically movable platform means for positioning a package of a plurality of flattened packaging container blanks covered with packaging material disposed around the plurality of flattened packaging container blanks;

cutting means for cutting the packaging material disposed around the plurality of flattened packaging container blanks to expose the flattened packaging container blanks for further processing;

main magazine means for stacking the plurality of exposed blanks after removal of the packaging material;

supply means for supplying individual blanks, one at a time from said main magazine means for further processing;

robot means including grasping means for grasping a predetermined number of blanks disposed on said platform and delivering said predetermined number of blanks to said main magazine; and raising means receiving individual blanks from said supply means for opening said individual blanks into blanks which are parallelpiped in shape solely by pressure exerted on exterior corners of the individual blanks.

2. A transport device as recited in claim 1, wherein said raising means includes two members which are movable relative to each other, said members being movable toward each other to form the individual blank into an initial parallelpiped shape and then into a parallelpiped shape substantially at right angles to said initial parallelpiped and then being movable away from each other to allow the individual blank to form a shape having a rectangular cross section.

3. A transport device as recited in claim 1, wherein said cutting means includes a pair of vertically movable knives and a pair of horizontally movable knives.

4. A transport device as recited in claim 3, wherein said cutting means further includes a horizontally movable knife which is movable at right angles to said pair of horizontally movable knives.

* * * * *